United States Patent [19]

Lautenschlager

[11] Patent Number: 4,642,846

[45] Date of Patent: Feb. 17, 1987

[54] MOUNTING PLATE FOR FURNITURE HARDWARE, ESPECIALLY CABINET HINGES

[75] Inventor: Karl Lautenschlager, Reinheim, Fed. Rep. of Germany

[73] Assignee: Karl Lautenschlager KG, Mobelbeschlagfabrik, Reinheim, Fed. Rep. of Germany

[21] Appl. No.: 805,736

[22] Filed: Dec. 6, 1985

[30] Foreign Application Priority Data

Dec. 8, 1984 [DE] Fed. Rep. of Germany ..... 3444851

[51] Int. Cl.[4] ..... E05D 5/00

[52] U.S. Cl. ..... 16/382; 16/238; 16/245; 16/370; 16/DIG. 39

[58] Field of Search ..... 16/382, 389, 238, 245, 16/370, DIG. 39, DIG. 43

[56] References Cited

U.S. PATENT DOCUMENTS 4,590,641 5/1986 Lautenschlager et al. ..... 16/238

FOREIGN PATENT DOCUMENTS 2751459 6/1978 Fed. Rep. of Germany .... 16/DIG. 43

*Primary Examiner*—Leonidas Vlachos

[57] ABSTRACT

The cabinet hinge mounting plate can be fastened to a cabinet wall by means of screws passing through openings provided in it in the form of slots. The slots are configured such that the screws associated with each of them, which are threaded only on a portion of their length but have an unthreaded section adjacent the screw head, will be held temporarily by their threaded portion in a central position in the length of the slot, but when they are driven all the way in they will be displaceable lengthwise of the slot. The slots have in the area of their central portion projections protruding each toward the opposite slot edge for the purpose of holding the crests of the threads of the associated fastening screws. At their upper side facing the head of the screws the slots are provided with a rebate which is engaged by a centering section of the screw, which is formed in the transition between the head and the shaft of the screw. The diameter of the centering section corresponds substantially to the full width of the rebate.

4 Claims, 5 Drawing Figures

MOUNTING PLATE FOR FURNITURE HARDWARE, ESPECIALLY CABINET HINGES

BACKGROUND OF THE INVENTION

The invention relates to a mounting plate for furniture hardware, especially for the adjustable mounting of the supporting wall-related part of cabinet hinges, which can be fastened on a cabinet wall by means of fastening screws passing through openings in the form of slots provided in the mounting plate. These slots are configured such that their associated fastening screws, which are provided with a thread only over a portion of the length of their shaft but have an unthreaded shaft section below their heads, are held by the free threaded-shaft front end in a central position in the slot, but when driven all the way in are displaceable in the slot in the direction of the latter.

Such mounting plates serve especially for the adjustable mounting of the carcase-related parts of articulated hinges, which today as a rule are in the form of an elongated supporting arm, while provisions are made for the adjustment of the supporting arm in its longitudinal direction on the one hand, and, on the other hand, in regard to the distance from the surface of the cabinet wall of the supporting arm end that bears the hinge link and extends forward beyond the mounting plate. The slots provided in the mounting plate furthermore permit an adjustment parallel to the surface of the cabinet wall in the direction of the slots when the fastening screws are loosened. In the case of so-called wing plates, these slots are formed on lugs projecting wing-like from opposite sides of the actual mounting plate (DE-GM No. 75 30 985).

In order to be able in such mounting plates to preinstall the fastening screws in the central position in the slots, it has been proposed in a known mounting plate of the kind described above (DE-PS No. 27 51 459) to configure the shafts of the fastening screws adjacent the heads so as to be narrower than the remaining threaded shaft section on a length corresponding approximately to the thickness of the lugs, and to provide indentations on the confronting longitudinal sides of the slots, giving the indentations a diameter equal approximately to the diameter of the threaded section of the shaft of the fastening screws, it being possible to provide the notches also with threads matching those on the fastening screws. The preinstallation of the fastening screws is thus accomplished by driving the threaded front end of the fastening screws into the indentations. When the screws are then further driven into associated bores in a cabinet wall to mount the hinge part, the threadless, narrowed section of the fastening screws enters the slot and the mounting plate is then displaceable on the fastening screws lengthwise of the slot to the degree permitted by the length of the slots. A definite guidance of the mounting plate such that displacement is permitted only in the direction of displacement, but not at right angles thereto, is effected only when the narrowed section of the fastening screws is in a position offset from the central position provided with the indentations and the width of the slots is approximately equal to the diameter of the narrowed section of the shaft of the fastening screws. On the other hand, in the central position no such definite guidance in the slot direction exists, because between the narrowed section of the fastening screw shaft and the indentations are clearances which permit displacements of the mounting plate in other than the slot direction.

Accordingly, the invention is addressed to the problem of constructing mounting plates of the kind concerned herein such that, on the one hand, preinstallation of their fastening screws in a central position in the slots will be possible, but on the other hand the assurance will be provided that the adjustment of the mounting plate fastened to a cabinet wall, after a slight loosening of the fastening screws, will be possible only lengthwise of the slots.

THE INVENTION

Setting out from a mounting plate of the kind mentioned in the beginning, this problem is solved in accordance with the invention in that the slots have on their two confronting longitudinal margins, in the area of the central position, projections extending toward each opposite margin for holding the crests of the threads of the associated fastening screw; that each slot is provided with a depression on its upper side facing the head of the fastening screw, and that the transition between the head of the fastening screw and its shaft is configured as a centering section whose diameter substantially corresponds to the full width of the depression. Therefore the mounting plate is no longer guided on a narrowed section of the shaft of the fastening screws, but by the centering section, which is greater than the diameter of the shaft, and which is associated with a corresponding depression in the mounting plate. The fastening screws therefore do not have to be narrowed by turning or other such operations in the threadless area adjoining the head, and the slight difference between the diameter of the threadless section of the screw and the diameter of the front end of the fastening screws as measured across the crests of the rolled threads will suffice to hold this front end, in the engaged state, between the projections in the slots, without interfering with the adjustment of the mounting plate when the fastening screws are driven in.

At the same time, the centering section of the screw head can have a smaller diameter than the screw head itself, in which case the axial height of the centering section will be approximately equal or slightly smaller than the depth of the depression.

Alternatively, the screw head itself can form the centering section, in which case its diameter will be substantially equal to the overall width of the depression.

The invention will be further explained by the following description of an embodiment, in conjunction with the drawing.

SUMMARY DESCRIPTION OF THE DRAWING

FIG. 1 is a perspective view of a mounting plate in accordance with the invention, made in the form of a wing plate, FIG. 2 is a view of one of the lateral wings of the mounting plate, seen in the direction of arrow 2 in FIG. 1, FIG. 3 is a cross-sectional view seen in the direction of arrows 3—3 in FIG. 2, FIG. 4 is a cross-sectional view seen in the direction of arrows 4—4 in FIG. 2, in which the upper part of the fastening screw is additionally represented as inserted into the slot in the fastening position, and FIG. 5 is a side view of a fastening screw serving to fasten the mounting plate in accordance with the invention.

DESCRIPTION OF A PREFERRED EMBODIMENT

Figure 1:
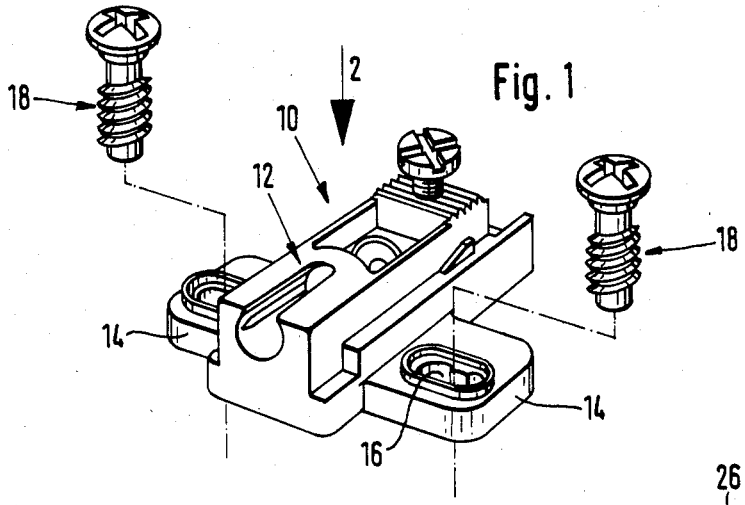

The embodiment of a mounting plate shown in the drawing and generally identified by the number 10, is in the form of a wing plate which is composed of the elongated, actual holding section 12 serving for the adjustable holding of the supporting arm of a cabinet hinge (not shown), and two wing-like projections 14 which extend from the opposite longitudinal margins of the holding section and are lower than the holding section. In the projections 14, slots 16 are provided at right angles to the longitudinal axis of the holding section 12, and through them the shaft of a fastening screw 18 can be driven into a bore (not shown) in a cabinet wall. To this extent the mounting plate 10 corresponds to known wing plates and the configuration of the holding section 12 and the arrangement and configuration of the means for the adjustable fastening of the hinge supporting arm on the holding section might correspond to known mounting plates, so that they need not be discussed in detail herein.

Figure 3:
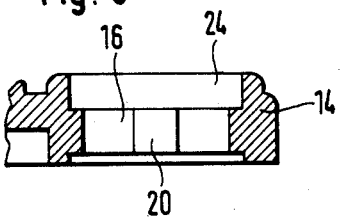
Figure 5:
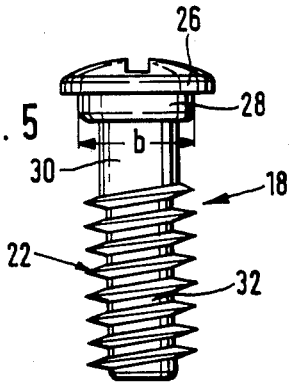
Figure 2:
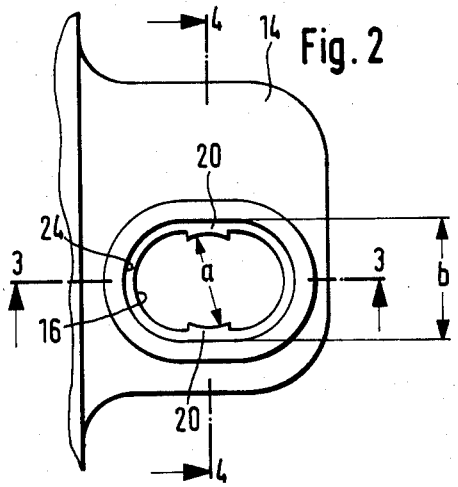
Figure 4:
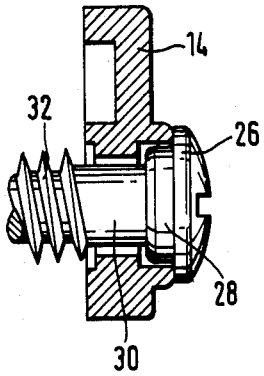

On the other hand, the configuration of the slots 16 in the wings 14, especially as shown in FIGS. 2 to 4, and of the corresponding fastening screw 18, shown separately in FIG. 5, is new and advantageous.

The slots 16 have short projections 20 on their confronting longitudinal margins. These projections 20 narrow the slot in this central portion to such a degree that the crests of the threads of the shaft 22 of the corresponding fastening screw driven between the projections 20 penetrate slightly into the material of the projections 20 and hold the fastening screw in place without offering excessively great resistance to turning the screw with a screwdriver. In the example represented, the projections 20 are configured on their surfaces confronting the screw shaft as sections of a cylindrical surface having the diameter a, while the diameter measured across the crests of the threads of the fastening screw 18 is slightly greater than a. The configuration of the projections 20 can also be other than that given in the drawing. For example, each projection 20 could be replaced by two strips extending in parallel spaced relationship transversely through the slot and protruding from the lateral margins of the slot to such an extent that they hold the threaded portion of the shaft 22 of the fastening screw in the described manner without hampering the turning of the shaft 22 when the screw is driven.

On the upper side of each slot 16 there is provided a depression 24 concentric with the slot and slightly larger than it, but it is straight along the longitudinal margins, i.e., it does not have any projections comparable to projections 20. The width b is thus slightly greater than the dimension a. On the underside of the head 26 of the corresponding fastening screw 18 there is provided a centering section 28 associated with the depression 24; the diameter of this centering section 28 corresponds approximately to the width b of the depression, or is smaller than b to such an extent that it fits loosely between the longitudinal margins of the depression 24. The axial height of the centering section 28 is slightly less than the depth of the depression 24, so that the annular portion of the bottom of screw head 26 radially overreaching the centering section will come in contact with the surface of the wing projection 14 surrounding the depression when the fastening screw 18 is tightened, and permit the wing projection, and with it the mounting plate, to be tightened against the underlying surface of a cabinet wall.

Adjacent the centering section 28, the shaft 22 of the fastening screw is smooth, i.e. not threaded, in a section 30 of the shaft length. This shaft section has a slightly smaller diameter than the diameter of the front, threaded shaft section 32 measured across the crests of the threads; this is because, when the thread is produced by rolling the blank shaft whose diameter is originally the same over its entire length, the crests of the threads are displaced radially outwardly by the material displaced from the thread roots. Consequently, no special turning of the screw shaft 22 below the screw head 26 is necessary. Instead, the above-mentioned slight difference between the diameter of the shaft section 30 and the outside diameter of shaft section 32 suffices to allow a displacement of the shaft section 30 lengthwise of the slot when the fastening screw in in the fully screwed-in position shown in FIG. 4, it being assumed, of course, that the screw 26 is slightly loosened, i.e., the screw head 26 is not tightened against the surface of the wing projection 14 surrounding the depression. In this longitudinal displacement, the mounting plate is not guided by the slots 16 against the shaft sections 30, but by the lateral edges of the depression 24 against the centering section 28. Since the diameter of the centering section 28 is presumably approximately equal to the width of the depression 24 between its longitudinal edges, the guidance of the mounting plate during its displacement is assured exclusively in the direction of the length of the slots 16, while displacement in other than this direction is impossible.

It is apparent that modifications and further developments of the described embodiment can be made within the scope of the concept of the invention. In particular it is possible to configure the screw head 26 itself as the centering section by making the width of the depression between its longitudinal margins equal to the diameter of the screw head 26. The centering section 28 is then unnecessary, and the screw head is tightened with its bottom against the bottom of the depression 14. The above-described embodiment of the mounting plate according to the invention is represented in the drawing as a metal die casting. The mounting plate, however, can also be in the form of a metal stamping; the projections 20 protruding from the longitudinal margins of the slots 16 are then formed by tongues formed by punching along the longitudinal margins of the slots, which are bent downwardly from the slot margins to permit the centering section 28 of the associated fastening screw to be guided over the entire length of the longitudinal margins of the slots. The free ends of the tongues are then bent back upwardly at right angles so that they point toward one another. These free tongue ends then serve for holding the threaded section of the inserted fastening screw.

I claim:

1. A mounting plate for furniture hardware, to be fastened on a piece of furniture, said mounting plate having at least one elongated slot therein for receiving a fastening screw having a head of a predetermined diameter, a section with threads remote from the head, and a threadless section between the head and the section with threads, the threadless section having a predetermined diameter; said elongated slot having confronting longitudinal margins, projections extending from said confronting margins towards each other in a central area of the slot, and a depression above said margins, of a predetermined depth and width, for receiving the head, whereby the section with threads can be held by the projections in a central position of the screw and the screw is displaceable in longitudinal direction of the slot when the threadless section is between said projections.

2. The combination of:

a mounting plate for furniture hardware, to be fastened on a piece of furniture, said mounting plate having at least one elongated slot therein; and at least one fastening screw having a head of a predetermined diameter, a section with threads remote from the head, and a threadless section between the head and the one section with threads, the threadless section having a predetermined diameter;

said elongated slot having confronting longitudinal margins, projections extending from said confronting margins towards each other in a central area of the slot, and a depression above said margins, of a predetermined depth and width, for receiving the head, whereby the section with threads can be held by the projections in a central position of the screw and the screw is displaceable in longitudinal direction of the slot when the threadless section is between said projections.

3. The combination according to claim 2, wherein the head has a centering section, the axial height of the centering section being approximately equal to or slightly smaller than the depth of the depression.

4. The combination according to claim 2, wherein the screw head has a diameter corresponding substantially to the width of the depression.

* * * * *